US008985078B2

(12) United States Patent
Chang

(10) Patent No.: US 8,985,078 B2
(45) Date of Patent: Mar. 24, 2015

(54) COMBUSTION CHAMBER STRUCTURE BY USING PREHEATING NET AND SPARK PLUG TO IGNITE

(75) Inventor: Lien-Sheng Chang, Taichung (TW)

(73) Assignee: Golden Lion Enterprise Co., Ltd., Taichung (TW)

( * ) Notice: Subject to any disclaimer, the term of this patent is extended or adjusted under 35 U.S.C. 154(b) by 461 days.

(21) Appl. No.: 13/599,809

(22) Filed: Aug. 30, 2012

(65) Prior Publication Data

US 2013/0291821 A1 Nov. 7, 2013

(30) Foreign Application Priority Data

May 2, 2012 (TW) ..... 101208223 U

(51) Int. Cl.

| | |
|---|---|
| ***F02P 13/00*** | (2006.01) |
| ***F02P 15/00*** | (2006.01) |
| *H01T 13/20* | (2006.01) |
| *F02B 23/08* | (2006.01) |
| *F02P 19/02* | (2006.01) |
| *H01T 13/18* | (2006.01) |

(52) U.S. Cl.

CPC ..... *F02P 15/001* (2013.01); *H01T 13/20* (2013.01); *F02B 23/08* (2013.01); *F02P 19/02* (2013.01); *F02D 2400/06* (2013.01); *H01T 13/18* (2013.01)

USPC ..... 123/169 EL

(58) Field of Classification Search

CPC ..... F02P 13/00; F02P 19/00; F02P 3/06; H01T 13/20; F02B 23/08

USPC ..... 123/169 EL; 313/141, 143, 118

See application file for complete search history.

(56) References Cited

U.S. PATENT DOCUMENTS

| | | | | |
|---|---|---|---|---|
| 3,015,321 | A * | 1/1962 | Stumpfig et al. | 123/255 |
| 5,517,961 | A * | 5/1996 | Ward | 123/169 EL |
| 6,858,974 | B2 * | 2/2005 | Moriya et al. | 313/141 |
| 7,652,413 | B2 * | 1/2010 | Kawashima | 313/141 |

* cited by examiner

*Primary Examiner* — Hieu T Vo

(74) *Attorney, Agent, or Firm* — Ming Chow; Sinorica, LLC

(57) ABSTRACT

A combustion chamber structure by using a preheating net and a spark plug to ignite includes a cylinder. The cylinder is connected with a connection seat. The connection seat has a threaded hole. A spark plug is fixedly connected in the threaded hole. A preheating net is transversely disposed under the spark plug. A certain distance is defined between the spark plug and the preheating net. When electrified, the spark plug and the preheating net will generate an electric arc to rise the temperature of the preheating net and to preheat the mixing oil gas in the combustion chamber. The present invention enhances the burning efficiency. The oil gas in the combustion chamber is complete combustion to enhance horsepower and to save oil. Besides, the present invention can decrease the exhaust gas so it is environment-friendly.

3 Claims, 4 Drawing Sheets

COMBUSTION CHAMBER STRUCTURE BY USING PREHEATING NET AND SPARK PLUG TO IGNITE

The current application claims a foreign priority to the patent application of Taiwan No. 101208223 filed on May 2, 2012.

BACKGROUND OF THE INVENTION

1. Field of the Invention

The present invention relates to a combustion chamber structure by using a preheating net and a spark plug to ignite.

2. Description of the Prior Art

The combustion chamber of a conventional engine is disposed in a cylinder. The existing combustion chamber structure comprises a spark plug screwed to a cylinder cover. The spark plug comprises a central electrode inserted in a ceramic insulation body. The ceramic insulation body is surrounded with a grounding metallic casing. Through the metallic casing, the spark plug is screwed to the cylinder cover. The top of the metallic casing is further fixedly connected with a grounding member. A gap is formed between the central electrode and the grounding member. Through the gap, the spark plug is electrified to ignite the mixing oil gas in the combustion chamber.

However, the existing combustion chamber structure uses the gap of the spark plug to discharge electricity to ignite the mixing oil gas. There is no device to preheat the oil gas or other device for complete combustion. When the existing combustion chamber structure is applied to a small-exhaust and high-speed model engine, the mixing oil gas in the combustion chamber is not complete combustion to exhaust a great amount of exhaust gas, which results in that the horsepower cannot release completely. The idling of the engine is not stable to extinguish the engine sometimes.

Accordingly, the inventor of the present invention has devoted himself based on his many years of practical experiences to solve these problems.

SUMMARY OF THE INVENTION

The primary object of the present invention is to provide a combustion chamber structure by using a preheating net and a spark plug to ignite. The oil gas in the combustion chamber can be preheated. When igniting, the oil gas can be compete combustion to lower the exhaust gas. The present invention can decrease the exhaust gas so it is environment-friendly and can enhance horsepower and save oil.

The combustion chamber structure by using a preheating net and a spark plug to ignite of the present invention comprises a cylinder. The cylinder has a combustion chamber therein. The cylinder has an opening to communicate with the combustion chamber. The combustion chamber structure comprises a connection seat located on the opening and connected with the cylinder. The connection seat has a threaded hole which communicates with the combustion chamber. The spark plug is fixedly connected in the threaded hole. The spark plug has a central electrode therein. The central electrode has an axial discharge end at one end thereof toward the combustion chamber. The discharge end functions as a positive pole of the spark plug. The other end of the central electrode protrudes out of the spark plug to form a connection portion. The preheating net is transversely disposed in the combustion chamber. The preheating net is fixedly connected to the connection seat and disposed under the discharge end of the spark plug. A certain distance is defined between the discharge end of the spark plug and the preheating net. When electrified, the discharge end of the spark plug and the preheating net will generate an electric arc to ignite.

Through the distance between the discharge end of the spark plug and the preheating net, the spark plug is electrified to generate an electric arc to ignite the mixing oil gas. Through the design of the preheating net, the electric arc results in that the temperature of the preheating net rises, meanwhile, the mixing oil gas in the combustion chamber is preheated. When igniting, the oil gas in the combustion chamber will be complete combustion. The present invention enhances the burning efficiency through the preheating oil gas to stabilize the idling of the model engine, not extinguishing easily. The oil gas in the combustion chamber is complete combustion to enhance horsepower and to save oil. Besides, the present invention can decrease the exhaust gas so it is environment-friendly. The discharge end of the spark plug won't be influenced through the protection of the preheating nut. The discharge end will not be humid because of the excess missing oil gas. There is no problem to ignite the spark plug.

DETAILED DESCRIPTION OF THE PREFERRED EMBODIMENTS

Embodiments of the present invention will now be described, by way of example only, with reference to the accompanying drawings.

Figure 1:
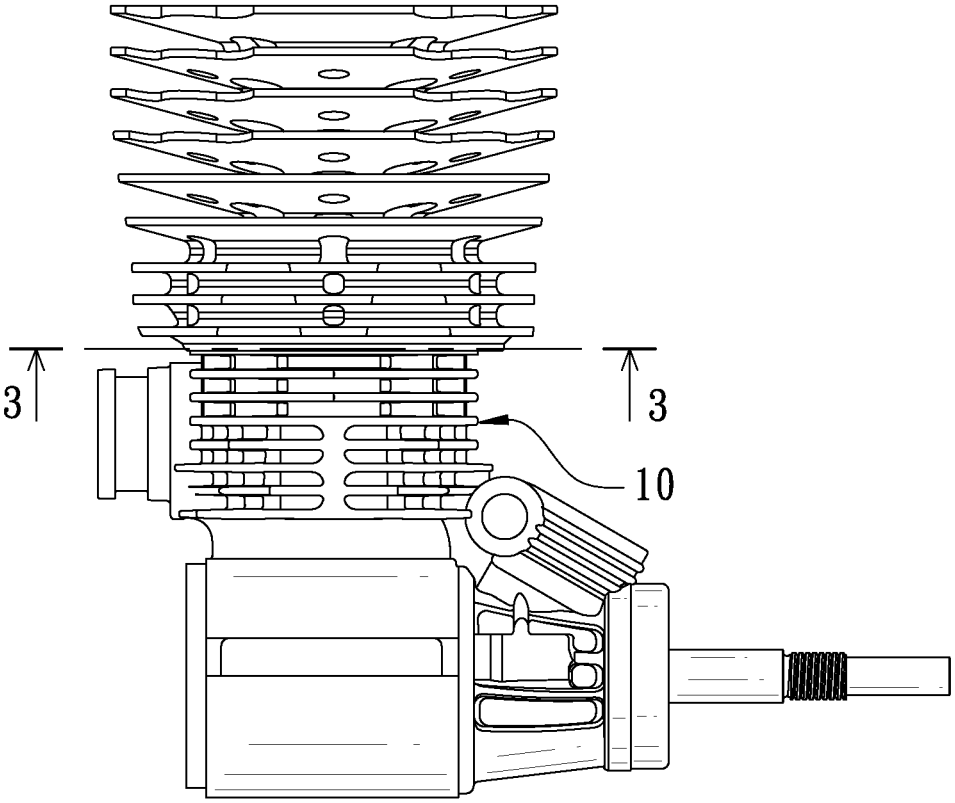
FIG. 1 is a side view according to a first embodiment of the present invention.
Figure 2:
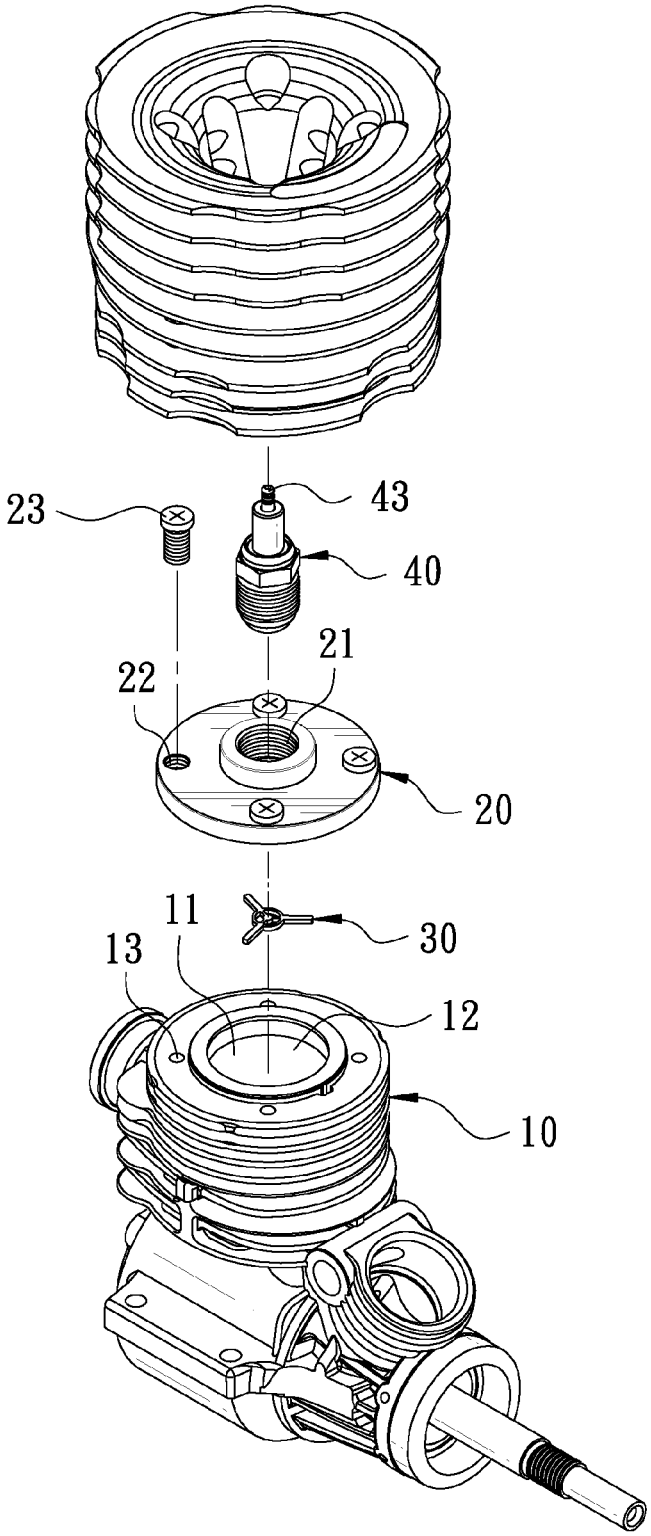
FIG. 2 is an exploded view according to the first embodiment of the present invention.

FIG. 1 is a side view according to a first embodiment of the present invention. FIG. 2 is an exploded view according to the first embodiment of the present invention. The present invention comprises a cylinder 10, a connection seat 20, a preheating net 30, and a spark plug 40.

The cylinder 10 has a combustion chamber 11 therein to accommodate mixing oil gas. The cylinder 10 has an opening 12 communicating with the combustion chamber 11 and four spaced connection holes 13 around the outer edge of the opening 12.

The connection seat 20 is located on the opening 12. The outer circumferential portion of the connection seat 20 has four spaced connection holes 22 corresponding in position to the connection holes 13 for connection of four bolts 23, so that the connection seat 20 is connected to the cylinder 10 to seal the opening 12. The connection seat 20 has a threaded hole 21. The threaded hole 21 communicates with the combustion chamber 11.

Figure 3:
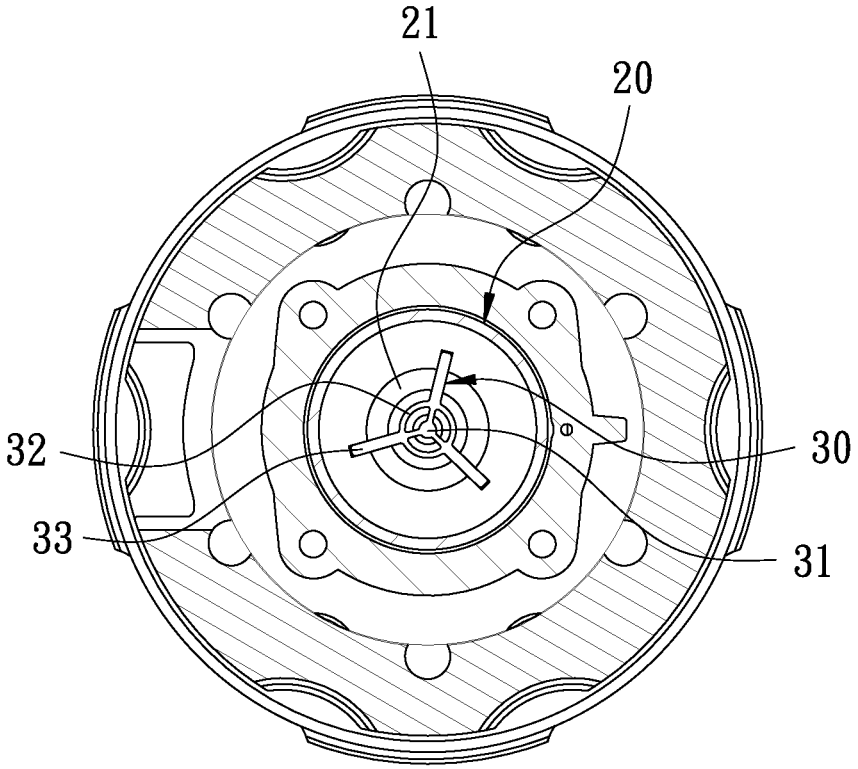
FIG. 3 is a sectional view taken along line 3-3 of FIG. 1.

FIG. 3 is a sectional view taken along line 3-3 of FIG. 1. The preheating net 30 is transversely fixed to the connection seat 20. The preheating net 30 is a grounding member as a negative pole. In this embodiment of the present invention, the preheating net 30 has a concentric annular fixing portion 32, a central stop portion 31 and three support portions 33 which are equally spaced and extend from the stop portion 32. The support portions 33 are fixedly connected to the outer circumferential edge of the threaded hole 21 of the connection seat 20.

Figure 4:
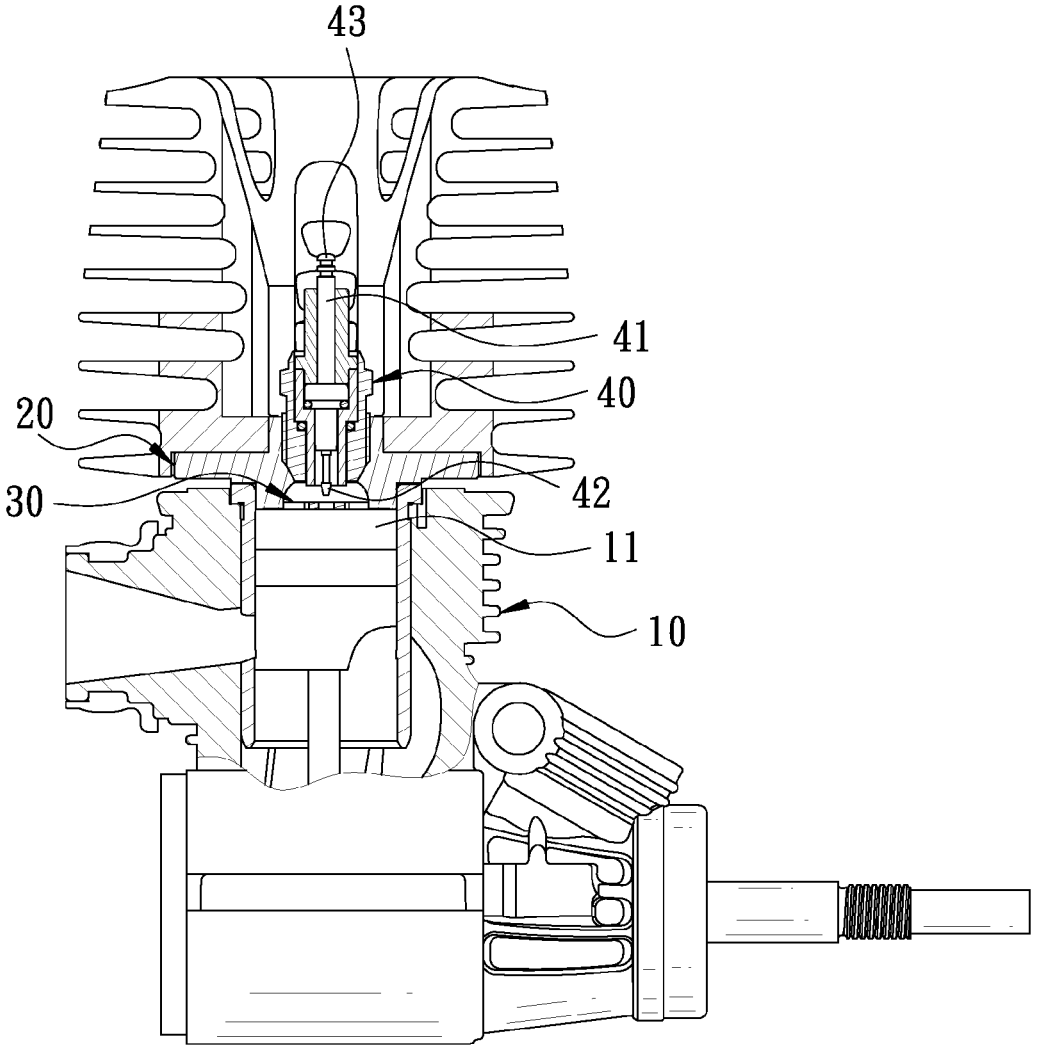
FIG. 4 is a side sectional view according to the first embodiment of the present invention.

FIG. 2 is an exploded view according to the first embodiment of the present invention. FIG. 4 is a side sectional view according to the first embodiment of the present invention. The spark plug 40 is fixedly connected in the threaded hole 21. The spark plug 40 has a central electrode 41 therein. The central electrode 41 has an axial discharge end 42 at one end thereof toward the combustion chamber 11. The discharge end 42 is located above the stop portion 31 of the preheating net 30, functioning as the positive pole of the spark plug 40. A certain distance is defined between the discharge end 42 of the spark plug 40 and the preheating net 30. The discharge end 42 of the spark plug 40 as the positive pole and the preheating net 30 as the negative pole will generate an electric arc when electrified to ignite. The central electrode 41 has a connection portion 43 at another end thereof. The connection portion 43 protrudes out of the spark plug 40 and is electrically connected with a power source.

Referring to FIG. 1 to FIG. 4, the present invention is mounted on a model engine. When the model engine is started, the electric current passes the electric electrode 41 through the connection portion 43 to the discharge end 42 to generate the electric arc through the distance defined between the discharge end 42 and the preheating net 30. This results in that the temperature of the preheating net 30 rises, meanwhile, the mixing oil gas is poured into the combustion chamber 11 to spread and fill the whole combustion chamber 11. Through the rise in the temperature of the preheating nut 30, the temperature of the oil gas rises to preheat the oil gas. After that, the oil gas is ignited by the electric arc at the gap between the discharge end 42 and the preheating net 30 to expand to the whole combustion chamber 11, so that the oil gas in the combustion chamber 11 is complete combustion to drive the engine. The present invention enhances the burning efficiency through the preheating oil gas to stabilize the idling of the model engine, not extinguishing easily. The oil gas in the combustion chamber 11 is complete combustion to enhance horsepower and to save oil. Besides, the present invention can decrease the exhaust gas so it is environment-friendly.

During the process that the mixing oil gas is poured into the combustion chamber 11 to spread and fill the whole combustion chamber 11, the discharge end 42 of the spark plug 40 won't be influenced through the protection of the stop portion 31 of the preheating nut 30. The discharge end 42 will not be humid because of the excess missing oil gas. There is no problem to ignite the spark plug 40.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A combustion chamber structure by using a preheating net and a spark plug to ignite, comprising a cylinder, the cylinder having a combustion chamber therein, the cylinder having an opening to communicate with the combustion chamber, the combustion chamber structure comprising a connection seat located on the opening and connected with the cylinder, the connection seat having a threaded hole which communicates with the combustion chamber, the spark plug being fixedly connected in the threaded hole, the spark plug having a central electrode therein, the central electrode having an axial discharge end at one end thereof toward the combustion chamber, the discharge end functioning as a positive pole of the spark plug, another end of the central electrode protruding out of the spark plug to form a connection portion, characterized by: the preheating net being transversely fixed to the connection seat and disposed under the discharge end of the spark plug as a negative pole of the spark plug, a certain distance being defined between the discharge end of the spark plug and the preheating net, when electrified, the discharge end of the spark plug as the positive pole and the preheating net as the negative pole generating an electric arc to ignite.

2. The combustion chamber structure as claimed in claim 1, wherein the preheating net has a central stop portion corresponding to the discharge end of the spark plug.

3. The combustion chamber structure as claimed in claim 2, wherein the preheating net has a concentric annular fixing portion and three support portions which are equally spaced and extend from the stop portion, the preheating net being fixedly connected to the connection seat by outer ends of the support portions.

* * * * *